United States Patent [19]

Stahl et al.

[11] Patent Number: 4,504,214

[45] Date of Patent: Mar. 12, 1985

[54] CONTROL VALVE FOR A BURNER WITH SHUTOFF CHARACTERISTICS

[75] Inventors: Karl-Heinz Stahl, Zum Felchen 20, D-7770 Überlingen/Nussdorf, Fed. Rep. of Germany; Fritz Fend, Lappersdorf, Fed. Rep. of Germany

[73] Assignee: Karl Heinz Stahl, Uberlingen, Fed. Rep. of Germany

[21] Appl. No.: 335,386

[22] Filed: Dec. 29, 1981

[30] Foreign Application Priority Data

Jan. 9, 1981 [DE] Fed. Rep. of Germany ..... 3100414

[51] Int. Cl.[3] ..... F23D 11/38

[52] U.S. Cl. ..... 431/121; 431/90; 251/61.3; 239/104

[58] Field of Search ..... 431/121, 90, 119; 251/61.3, 61.2; 239/106, 124, 126, 533.1, 570, 104; 222/52, 57

[56] References Cited

U.S. PATENT DOCUMENTS 3,817,264 6/1974 Kilayko ..... 251/61.3 X

FOREIGN PATENT DOCUMENTS 211590 5/1956 Australia ..... 431/121
746068 3/1956 United Kingdom ..... 431/121
1237076 6/1971 United Kingdom ..... 431/121

*Primary Examiner*—Samuel Scott
*Assistant Examiner*—Kenichi Okuno
*Attorney, Agent, or Firm*—Toren, McGeady and Stanger

[57] ABSTRACT

A control valve for a resonant burner having a burner space for receiving active substance through a conduit with an atomizing nozzle discharging into the space is disclosed. When the valve is shut off to terminate flow of the active substance through the valve to the burner conduit, a spring action in the valve tends to withdraw the active substance from the conduit by creating a suction effect therein.

5 Claims, 2 Drawing Figures

CONTROL VALVE FOR A BURNER WITH SHUTOFF CHARACTERISTICS

The present invention relates generally to burner apparatus and more particularly to a valve for controlling the flow of an active substance to a burner. The invention particularly concerns a device for a resonant burner for controlling shutoff of the resonant burner and for controlling the flow of an active substance which is to be atomized and which is discharged from a discharge nozzle that opens in a resonant burner space.

More particularly, the invention is directed toward a valve device of the type described which, when a burner is taken out of operation or is turned off, will automatically insure that no active substance issues from a nozzle through which the active substance is delivered to the burner.

SUMMARY OF THE INVENTION

Briefly, the present invention may be described as a valve assembly for a burner for controlling delivery thereto of an active fluid substance comprising conduit means including nozzle means through which said active substance is delivered to the burner, air intake means for the burner, valve means operating under the influence of said air intake means for controlling flow of the active substance to the conduit means, and spring means operatively associated with the valve means, said valve means operating under the influence of said spring means to create a suction effect in said conduit means when said valve means is moved to a position terminating flow of said active substance thereto.

In accordance with the present invention, the objects thereof are achieved in that the device of the invention is characterized by a valve arrangement which by being responsive to the stream of intake air of a resonant burner can be shifted or adjusted against a spring tension. When there occurs a cessation of the air intake stream, the valve arrangement acts under a spring tension to create a suction that draws the active substance back from the nozzle through the pipeline leading to the resonant burner space.

In principle, an individual pipeline can be provided having a valve mechanism which may be manually adjusted for feeding the active substance into the resonant burner space. In a preferred embodiment of the invention however the pipeline in which the suction or draft is created when there occurs a cessation of the air intake stream is at the same time the same pipeline through which the active substance is introduced into the resonant burner space. In this case, the embodiment of the invention is characterized in that the pipeline is run from an active substance supply container via the valve arrangement to a resonant burner space and, moreover, is shut by the valve arrangement when there is a cessation of the air intake stream.

An embodiment of the invention which is especially simple in its construction is one wherein the valve means comprise a sliding valve of which a slider is arranged to be adjusted by a diaphragm. The diaphragm may be arranged to adjoin a space which has an air inlet opening through which air flows in with a pressure that is dependent upon the strength of the air intake stream of the resonant burner. This space may be formed with a first, small outlet opening through which air flows and which is always open, and with a second outlet opening which may be opened or shut by a manually operable adjusting member.

In normal operation, the diaphragm is only under a pressure which is generated due to the small outlet opening which remains constantly open. By opening the second outlet opening by means of operation of the manually operable adjusting member, this pressure on the diaphragm may be reduced whereby the sliding valve may be moved into a position to shut the flow of active substance therethrough.

In order to obtain a desired reverse draft or suction effect with this structural arrangement, a preferred arrangement is one in which the slider is coupled with a second diaphragm which adjoins an area through which the active substance flows downstream from the sliding valve. If the sliding valve is shifted into its closed position, this space will thereby automatically be enlarged thereby resulting in the desired suction or reverse draft effect.

If at least one of the diaphragms is not of an automatically spring actuated construction, the slider in the sliding valve shut position is preferably prestressed or initially tensioned by means of a spring.

If air is conducted into the active substance container with a pressure which is dependent upon the air intake stream, in order to facilitate the issuance of the active substance from the container, the operative surface of the first diaphragm is preferably made larger than the surface of the second disphragm so that the aforesaid space can be securely expanded in order to provide the reverse draft or suction effect upon the active substance.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 1:
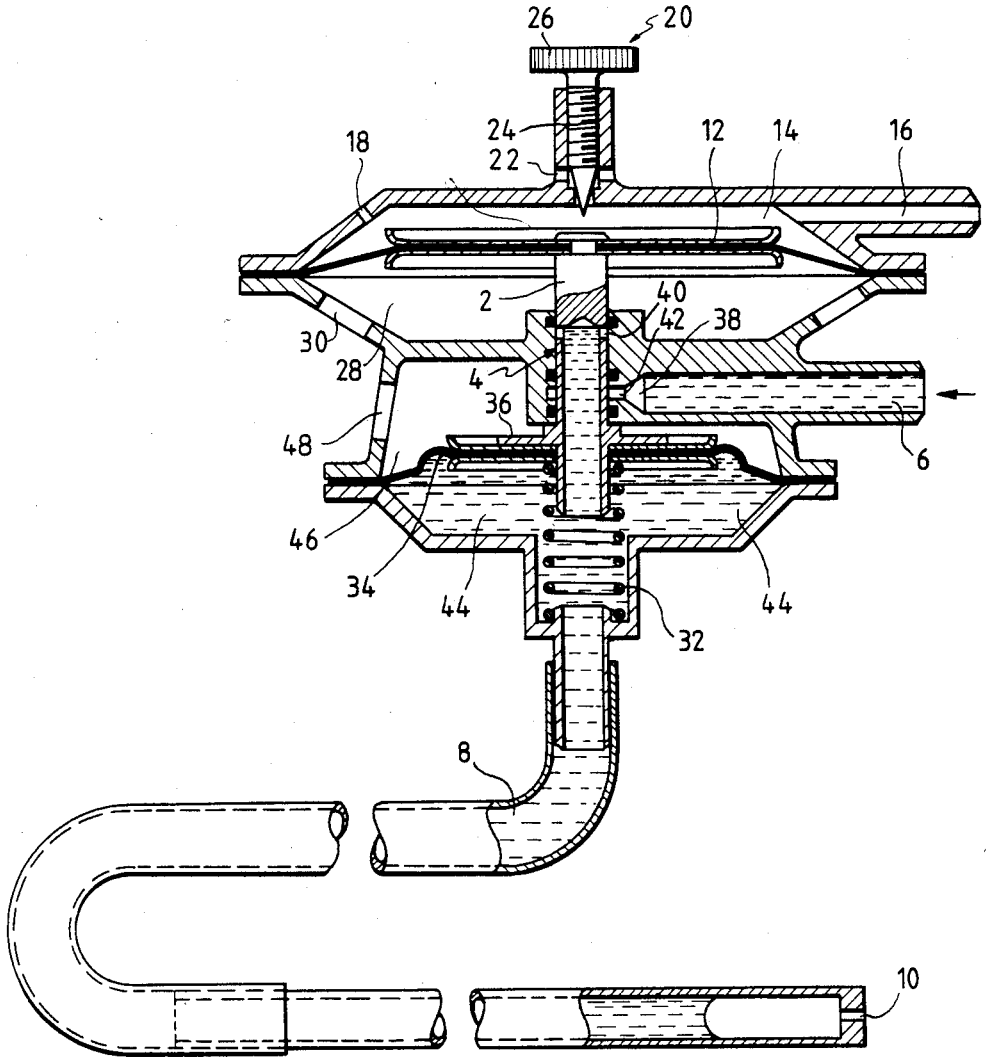
FIG. 1 is a schematic sectional view depicting a first embodiment of the invention wherein the pipeline which serves to convey active substance to a nozzle is at the same time the pipeline within which the draft or suction is created.

Referring now to FIG. 1 wherein there is shown a first embodiment of the invention, the embodiment depicted includes valve means which are essentially composed of a slider 2 forming part of a sliding valve 4 which is situated in a pipeline 6, 8 extending under an active substance supply container (not shown) to a resonant burner space (also not shown).

The pipeline 6 is connected on the input side thereof with the active substance supply container. The pipeline 8 has at the terminal end thereof a nozzle 10 which adjoins a resonant burner space.

The slider 2 is actuated under the control or influence of a diaphragm 12. Additionally, the diaphragm 12 is arranged to adjoin a space 14 which has an air inlet opening 16 through which air flows with a pressure level that is dependent upon the strength of the intake air stream for the resonant burner. Moreover, this space includes a first, small outlet opening 18 through which air flows outwardly thereof and which is maintained constantly open. A second outlet opening 22 is provided in flow communication with the space 14, with the opening 22 being adapted to be opened and shut by operation of a manually operable adjusting member 20. The adjusting member 20 is provided with a screw member 24 which is threadedly engaged in the valve assembly and which may be turned by means of a knurled grip 26. Rotation of the threaded member 24 for movement thereof in a downward direction will operate to shut the flow through the opening 22. When flow in the opening 22 is closed, pressure in the space 14 will increase thereby causing the diaphragm 12 to be moved downwardly in order to push the slider 2 in a downward direction. This downward movement of the slider 2 will cause the sliding valve 4 to be brought into its open position.

A space 28 is provided underneath the diaphragm 12 with this space being connected through openings 30 with the ambient atmosphere.

A spring member 32 located beneath the sliding valve member 2 operates to apply an upwardly directed spring force acting against the pressure which exists in the space 14 in order to transfer the sliding member 2 into the shut or closed position. Thus, the spring member 3 acts against the downward force of the diaphragm 12 which may be created by increased pressure in the space 14.

The slider valve member 2 extends through a second diaphragm 34 upon which it is affixed by means of a flange 36. The slider valve member 2 has a hollow interior and active substance flowing inwardly through the pipeline 6 may pass through a neck or narrowed portion 38 and through an annular distribution space 42 so as to flow into the interior of the slider valve member 2 when openings 40 formed in the slider valve member 2 are brought to a vertical position which is in alignment with the annular distributor space 42.

Thus, in order to shut off flow of the active substance from the pipeline 6 into the pipeline 8, the slider valve member 2 may be raised to bring the openings 40 out of alignment with the annular distributor 42. Flow will be reestablished when, by lowering the slider valve member 2, the openings 40 are brought into alignment with the annular distributor 42.

Before the active substance comes into the pipeline 8 it will flow through a space 44 beneath the diaphragm 34. When the slider valve member 2 is brought into the shutoff position, it will cause the diaphragm 34 to be moved upwardly therewith. As a result of this the volume in the space 44 will be enlarged and thereby the active substance within the space 44 will be drawn out of the pipeline 8 by a reverse draft or suction effect created in the space 44 when the second diaphragm 34 is lifted by virtue of the upward movement of the slider valve member 2.

The diaphram 34 has a space 46 located thereabove which is in constant communication with the atmosphere by means of an opening 48.

Figure 2:
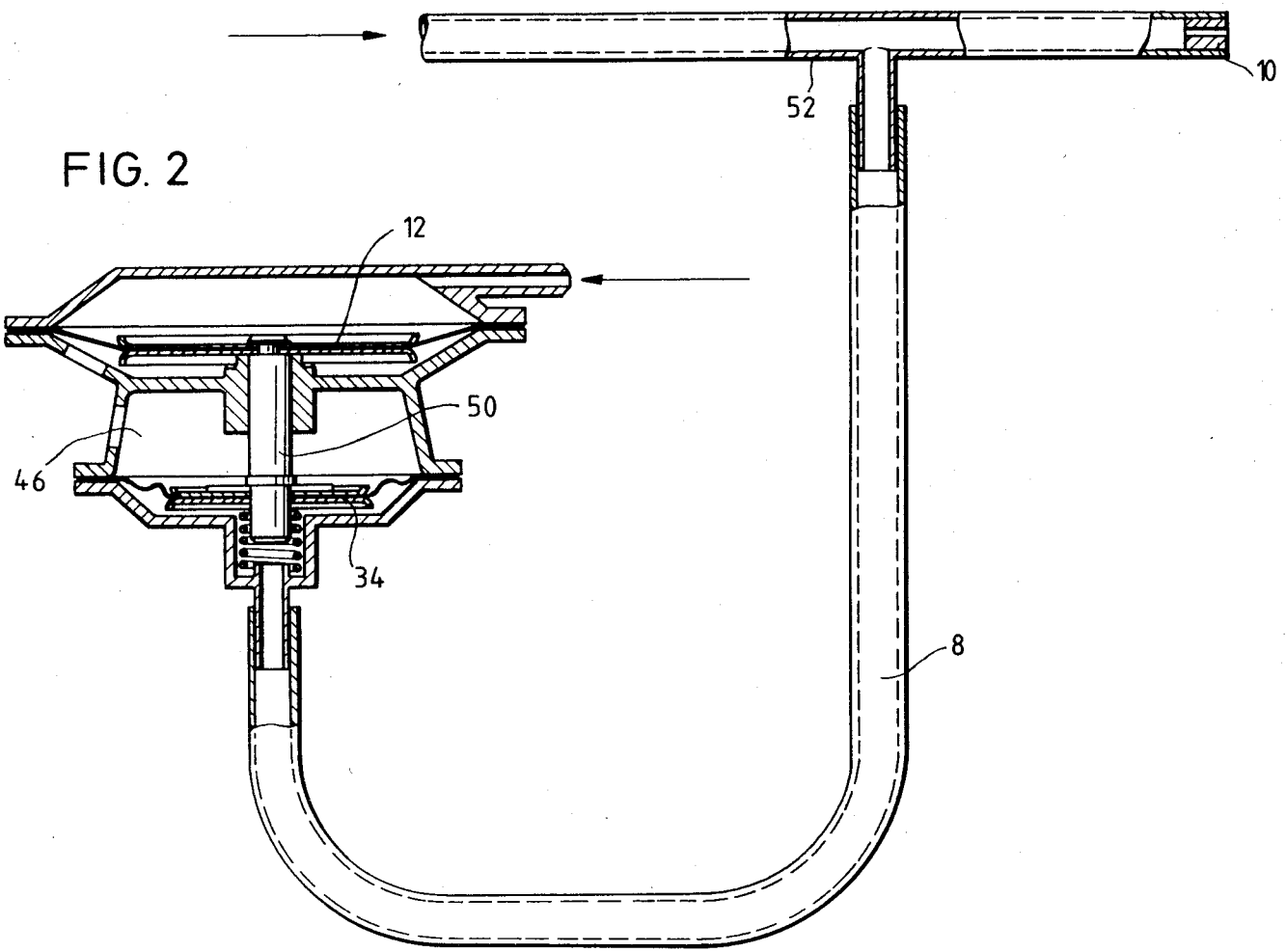
FIG. 2 is a schematic sectional view showing a second embodiment of the invention wherein that pipeline in which the draft is generated is an isolated or individual pipeline.

A second embodiment of the invention is shown in FIG. 2. In the embodiment of FIG. 2, the construction of the valve assembly is essentially the same as that of the embodiment in FIG. 1 so that only various elements need to be described in connection with the embodiment of FIG. 2. Instead of the slider valve member 2, an adjustable pin 50 is provided which connects the two diaphragms 12, 34. The pipeline 6 leading from the active substance container into the space 46 above the diaphragm 34 has been dispensed with. The pipeline 8 opens into a pipeline 52 which leads to the nozzle 10. The pipeline 52 is connected to the input side via a tap or faucet with the active substance container.

While specific embodiments of the invention have been shown and described in detail to illustrate the application of the inventive principles, it will be understood that the invention may be embodied otherwise without departing from such principles.

What is claimed is:

1. A valve assembly for controlling delivery of an active substance to a burner in response to a fluid signal which is indicative of burner operation comprising:

inlet means through which said active substance is delivered to said valve assembly;

outlet means for delivering said active substance to said burner from said valve assembly, said outlet means including a discharge chamber through which said active substance flows;

a valve mechanism interposed between said inlet means and said outlet means including a valve member movable to open and close said valve mechanism to control the flow of said active substance therethrough;

a first diaphragm affixed to said valve member and movable therewith to control movement thereof to open and close said valve mechanism in response to a fluid signal;

fluid delivery means adapted to enable delivery to said first diaphragm of a fluid signal for controlling operation of said valve mechanism, said first diaphragm being arranged to effect movement of said valve member to open and close the valve mechanism in response to said fluid signal;

a second diaphragm affixed to said valve member and movable together therewith, said second diaphragm having said discharge chamber arranged contiguously therewith on one side thereof and being operable, upon movement of said valve member in a direction to close said valve mechanism, to enlarge the volume of said discharge chamber thereby to create a suction effect tending to draw active substance into said discharge chamber away from said burner, and said valve member comprising a hollow cylindrical slider, and said valve mechanism further comprising means defining an annular distributor space extending externally about said slider, said slider having an opening extending therethrough which is moved into and out of alignment with said annular distributor space to open and close said valve mechanism.

2. In a resonant burner having a burner space for receiving active substance through an atomizing nozzle discharging into said burner space, an arrangement for controlling the discharge of said active substance through the nozzle when the resonant burner is shut off, said arrangement comprising a valve assembly having a chamber (44), said chamber communicating with the nozzle (10) through a line (8) conveying active substance, a membrane (34) limiting the volume of said chamber, a spring member (32) biased against said membrane to urge said membrane in a direction to increase the volume of said chamber, and an adjusting member (2, 50) acting on said membrane to decrease the volume of said chamber when the intake air flow pressure of the burner increases, whereby, upon shutting off said burner, the volume of said chamber is increased by the action of said spring on the membrane and a suction effect is created to suck active substance from the nozzle, said adjusting member (2) being in the form of a hollow cylindrical slide forming part of a slide valve (4), active substance being supplied to said chamber (44) through a line (6) communicating with a receptacle for said active substance, an annular distribution space (42) and through an opening (40) in the wall of said hollow cylindrical slide, when the volume of the chamber (44) is below a predetermined value.

3. The arrangement of claim 2, wherein said chamber is filled with active substance.

4. An arrangement as claimed in claim 2, further comprising a second membrane (12), said adjusting member (2, 50) being connected with said second membrane, and said second membrane limiting the volume of a second chamber (14), the volume of said second chamber being dependent on the intake air flow pressure of the resonant burner.

5. An arrangement as claimed in claim 2, wherein the line (8) leading to the nozzle (10) opens up into a line (52) connected with a receptacle for the active substance.

* * * * *